US005467972A

United States Patent [19]

Lee et al.

[11] Patent Number: 5,467,972

[45] Date of Patent: *Nov. 21, 1995

[54] PANEL CLAMPING APPARATUS

[75] Inventors: Leonard G. Lee; John S. Lynn, both of Ottawa; Francis A. McLean, Oxford Station; Edwin C. Tucker, Ottawa; Lloyd Sevack, Nepean, all of Canada

[73] Assignee: Lee Valley Tools, Ltd., Ottawa, Canada

[ * ] Notice: The term of this patent shall not extend beyond the expiration date of Pat. No. 5,284,331.

[21] Appl. No.: 180,031

[22] Filed: Jan. 11, 1994

Related U.S. Application Data

[63] Continuation-in-part of Ser. No. 961,489, Oct. 15, 1992, Pat. No. 5,284,331.

[51] Int. Cl.[6] ..... B25B 1/00

[52] U.S. Cl. ..... 269/118; 269/155; 269/900; 269/134; 269/296

[58] Field of Search ..... 144/286 A, 286, 144/287; 269/900, 901, 139, 155, 152, 283, 258, 88, 91–94, 295, 222, 221, 15, 16, 134, 104, 111, 118, 296

[56] References Cited

U.S. PATENT DOCUMENTS

| | | | |
|---|---|---|---|
| 95,337 | 9/1869 | Goulden | 269/93 |
| 1,954,708 | 4/1934 | Mass | 269/900 |
| 4,121,817 | 10/1978 | Pavlovsky | 269/900 |
| 4,157,819 | 6/1979 | Meyer | 269/900 |
| 4,415,149 | 11/1983 | Rees | 269/900 |
| 4,671,500 | 6/1987 | Mark | 269/155 |
| 5,058,870 | 10/1991 | Cetnar | 269/155 |
| 5,342,031 | 8/1994 | Yu-Fang | 269/155 |
| 5,356,124 | 10/1994 | Ai | 269/155 |

*Primary Examiner*—Robert C. Watson

*Attorney, Agent, or Firm*—Kilpatrick & Cody; John S. Pratt; Scott T. Weingaertner

[57] ABSTRACT

A clamping apparatus having a fixed post with a pad and a clamping jaw post with a threaded hole, through which a screw with a handle on one end and a pad on the other passes. The clamping apparatus may be used with rails so that on the bottom rail the fixed post is placed within one hole and the clamping jaw post placed within another hole such that a workpiece may be clamped between the two, and additionally a top rail with holes that the other ends of the fixed and clamping jaw post engage with may be added to prevent the workpiece from buckling when clamping pressure is applied by turning the screw.

20 Claims, 2 Drawing Sheets

PANEL CLAMPING APPARATUS

This application is a continuation-in-part of U.S. patent application No. 07/961,489 now U.S. Pat. No. 5,284,331, filed on Oct. 15, 1992, having the title Woodworking Bench System.

BACKGROUND OF THE INVENTION

This invention relates to woodworking devices for holding workpieces.. One of the oldest needs in the field of woodworking is the need to hold a workpiece. Solutions have been developed in great variety throughout the world, although it can be argued that eastern and western woodworking have followed different paths. Eastern woodworking typically uses somewhat simpler devices for holding workpieces, and woodworkers' feet are often directly involved. Western woodworkers typically work standing and have, by contrast, evolved the extensive use of clamping devices to hold workpieces. Examples of such devices include workbenches utilizing bench dogs, woodworking vises, hold-downs or panel clamps.

Numerous panel clamps also exist for clamping boards edge to edge in joining panels, including, among others, sash, bar and pipe clamps. Many of such existing clamps are excellent devices, but most are quite expensive and limited in the panel width they can accommodate. For instance, U.S. Pat. No. 4,671,500 issued to Mark discloses a "Double Acting Clamp." The Mark device uses guide plates for holding the material. A clamp is connected to each end of the guide plates by means of angled linkages that insert into notches on either side of the guide plates. See FIGS. 1–2, 4. Exertion of pressure through a jack screw 11 results both in a downward force against the guide plates and a side force against the material. Col 1, lines 62–8. The range of materials that can be clamped by a set of guide plates, however, is limited by the placement on the guide plates of notches for anchoring the linkages. Notches are placed on only the end of the guide plates, thus limiting the range of materials that can be accommodated by any one set of guide plates, and thereby requiring the user to purchase different sized guide plates.

SUMMARY OF THE INVENTION

The panel clamping apparatus of the present invention utilizes two rails, or one rail and a workbench top, to capture a panel between a fixed jaw and a clamping jaw. The fixed jaw has a pad positioned on a fixed post positioned between the rails (or rail and bench top), and the clamping jaw has a pad on one end of a clamping screw that is journaled through a clamping jaw post, also positioned between the rails or rail and bench top. Friction-increasing structures on the post such as barb-shaped or conventional threads, or angular ridges or knurling, resist withdrawal of the post from the rails (or bench top), thereby effectively maintaining the rails (or bench top) in contact with the face of a panel being clamped within the fixture. This encourages the panel members to remain in alignment during clamping by resisting any tendency such members may have to slip relative to each other or perpendicular to the faces of the rails or bench top.

Each of the rails have a series of matching holes located at intervals less than the travel of the clamping screw, so that a panel of any width (within the capacity of the rails) may be accommodated. One of the rails can also be made sufficiently thick doubly to serve as the lower rail for another panel clamping apparatus holding a different panel that can be easily stacked atop the bottom apparatus, thus allowing clamping of multiple, stacked panels and consequently saving workspace.

Typically, rails of the desired size will be selected by the user, who will then match-drill appropriate diameter holes through the upper and lower rail as a set. The distance between the holes is normally less than the maximum travel of the clamping jaw screw. Placing two or more lower rails upon a flat surface, the user positions the panel clamping apparatus at positions such that the distance between the clamping jaw post and the fixed post is slightly larger than the panel to be clamped. The mating edges of boards to be joined into a panel are brushed with glue and then laid flat on the lower rails. The fixed post pad and the clamping jaw pad are adjusted to center upon their respective panel edges. Clamping screws are then progressively and independently tightened to apply pressure to fuse the panels. Of course, a non-stick material such as wax paper can be placed upon the rails to prevent the transfer of excess glue onto the rails.

Alternatively, the user may use the panel clamping apparatus with only one rail, or only a bench top. This allows any number of different workpieces with varying shapes to be firmly clamped for working.

DETAILED DESCRIPTION OF THE DRAWINGS

Figure 1:
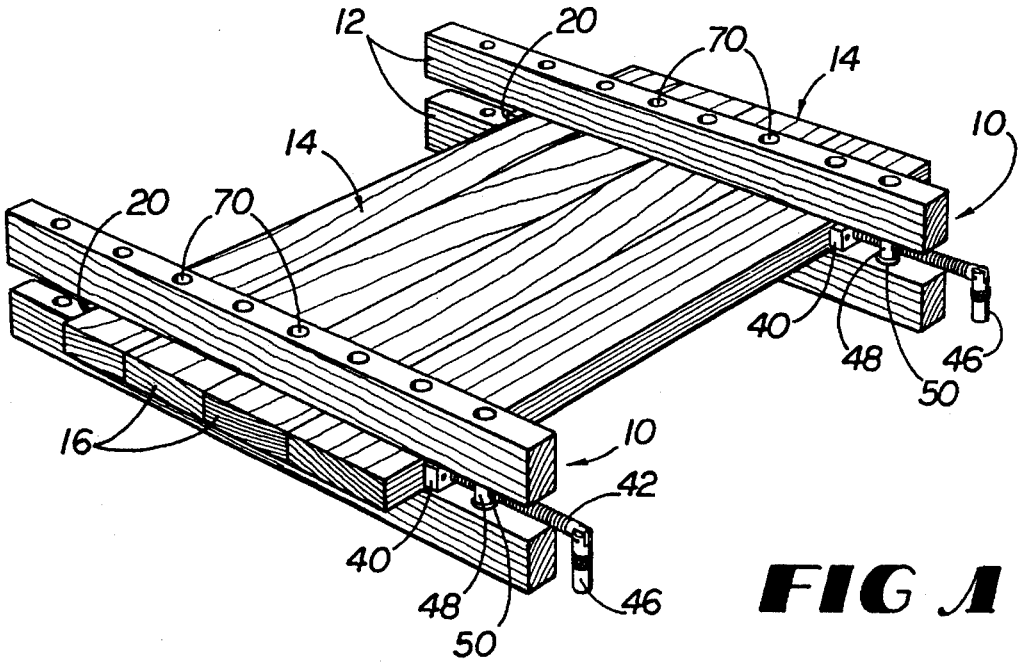
FIG. 1 is a perspective view of the panel clamping apparatus using two matching rails and shown clamping four boards edge-to-edge.
Figure 3:
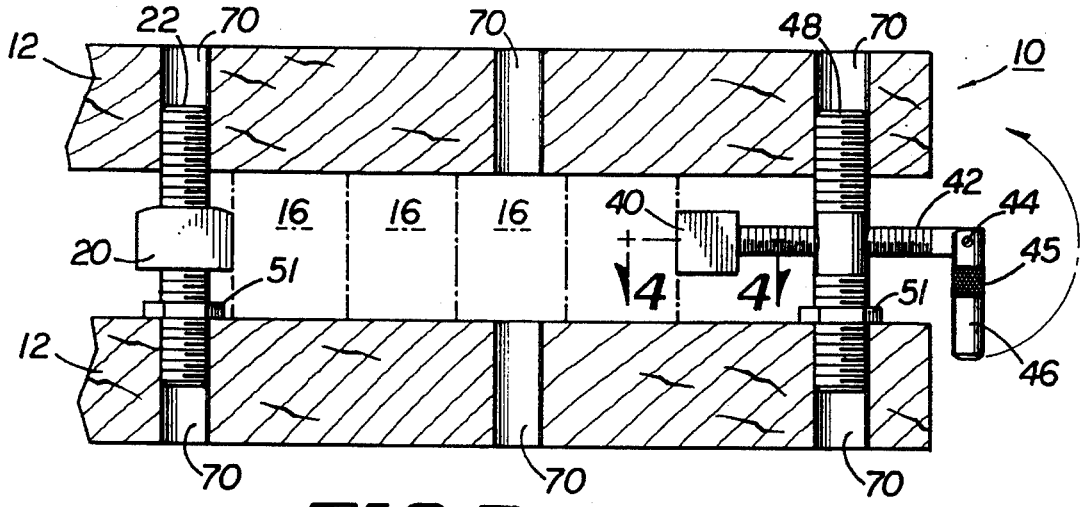
FIG. 3 is a side elevation view of the panel clamping apparatus of the present invention depicted in FIG. 1 using two matching rails and shown clamping four boards edge-to-edge.

Two panel clamping fixtures 10 are illustrated in FIG. 1 utilizing four substantially identical rails 12. As is illustrated in FIG. 1 and FIG. 3, panel 14 to be clamped is captured between a fixed jaw pad 20 on fixed post 22 and a clamping jaw pad 40 on one end of a clamping screw 42 that has a pin 44 connecting screw 42 to handle 46. Screw 42 is threaded through a clamping jaw post 48. As will be readily understood by reference to FIGS. 1 and 3, clamping fixture rails 12 may be made of any convenient length adequate to span the widest anticipated panel 14 (consisting of boards or panel members 16 that are to be joined). Each of rails 12 has a series of matching holes located at intervals less than the travel of clamping screw 42 in clamping jaw post 48, so that a panel 14 of any width (within the capacity of rails 12) may be clamped between fixed jaw pad 20 and clamping jaw pad 40 by appropriate location of fixed post 22 within rails 12 and rotation of handle 46. Selection of locations for holes 70 in rails 12 may be accomplished so that at least some of holes 70 match holes 80 in bench top 82 of FIG. 5. Thus, the panel clamping apparatus illustrated in FIG. 1 may be used with bench top 82 as a replacement for one of the rails 12.

Each of posts 22 and 48 are sections of round rod and may desirably be threaded along their entire length to receive their respective fixed jaw pad 20 (in the case of fixed post 22) or, as illustrated in FIG. 3, nuts 51 (in the case of clamping jaw post 48 or fixed jaw post 22). Such threading also reduces the tendency of the posts 22 and 48 to slip within holes 70 in rails 12. However, the threading can be limited to the center of the post 22 (as for instance, by reducing the diameter of the ends of the post 22) so that fixed pad 20 can be adjusted to center on panel 14. Ramped or barb-like thread can be used, as can machine and other threads, to resist withdrawal of posts 22 and 48 from holes 70 of rails 12. Elastic rubber or neoprene O-rings 50 also limit penetration of fixed jaw post 22 and clamping jaw post 48 into holes in the rails 12 or bench top 82. Alternatively, fixed jaw pad 20 can be fixed in place with a set screw or by welding or other conventional means.

Each of post 22 and 48 may be made of a variety of materials, although an appropriate grade of steel is likely to provide the desired combination of strength and economy. Pads 20 and 40 or nut 51 may also be made of steel, but fabrication of these parts in brass is an attractive alternative. Pad 20 can be a square nut that is threaded onto post 22, although other shapes and methods of fixation on post 22 may also be utilized so long as a surface of appropriate size and shape is provided for contact with panel 14. In the alternative embodiment illustrated in FIG. 3, nut 51, by contrast, does not bear against the workpiece panel 14, but does facilitate positioning post 48 or post 22 within the holes 70 in rails 12. Accordingly, while nut 51 can be square, round, knurled or plain, a conventional hexagonal shape is also appropriate.

Figure 4:
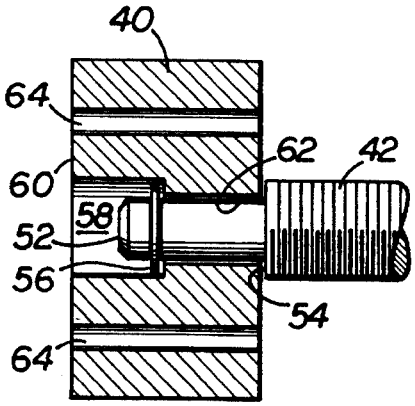
FIG. 4 is a cross-sectional view of the clamping jaw pad of the present invention.

Clamping jaw pad 40 must be fixed to the end of screw 42 so that it may rotate while pad 40 remains fixed relative to panel 14. Such attachment may be accomplished in a number of conventional manners. In the method illustrated in FIG. 4, the end 52 of screw 42 is turned to a reduced diameter so that a shoulder 54 is formed, and an annular depression is formed near the end 52 to receive a split locking ring 56 that seats within a recess 58 in the face 60 of pad 40, which recess 58 may be a blind bore coaxial with and larger in diameter than hole 62. Holes 64 in pad 40 facilitate the attachment of auxiliary (typically wood) jaws in a wide variety of shapes to facilitate use of panel clamping apparatus 10 with workpieces of various shapes or to protect panels 14 from damage otherwise possibly resulting from direct contact with pad 40.

Figure 2:
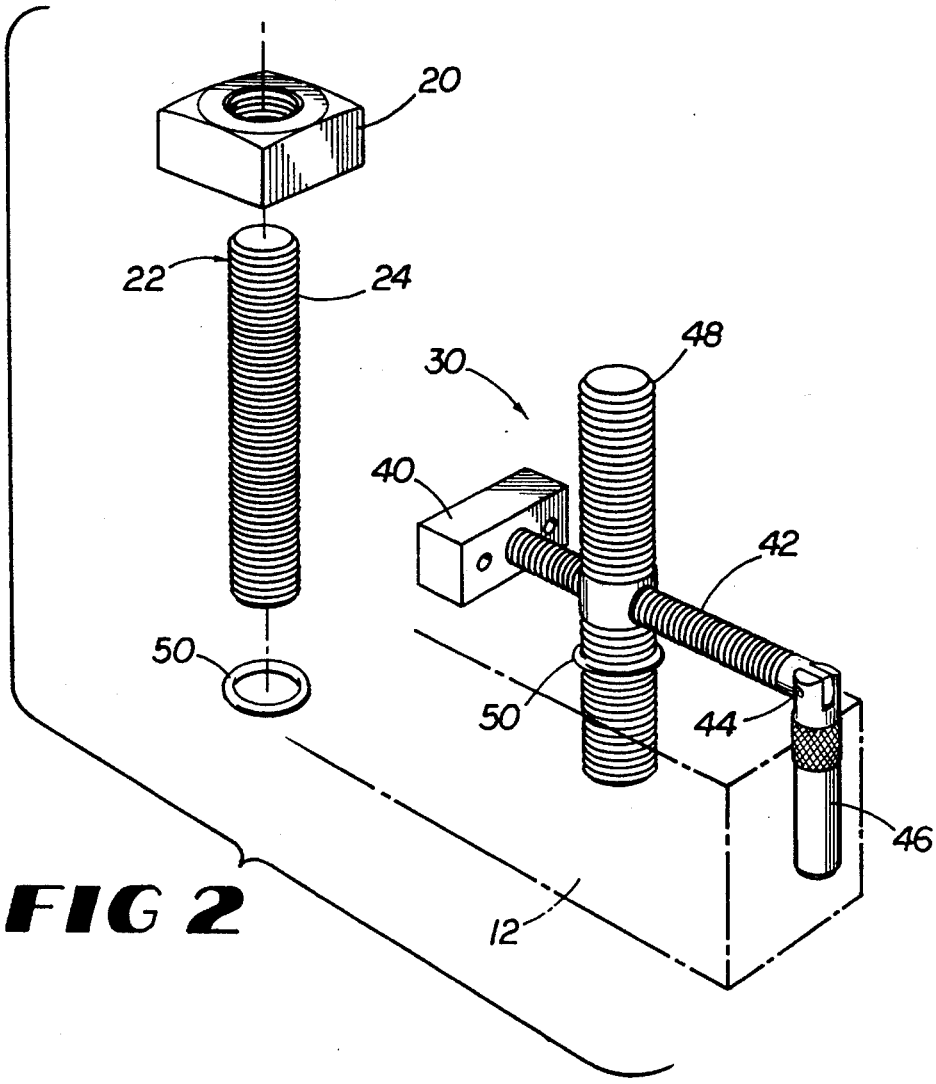
FIG. 2 is a perspective view of one embodiment of the post and the clamping jaw post of the present invention.

Screw 42 may be rotated to move pad 40 with a handle 46 that may be a flat section of plate fixed to pivot on a pin 44 in a slot in the end of screw 42. Alternatively, and preferably, handle 46 is formed of a short section of round rod as illustrated in FIG. 2 and is attached to pivot on pin 44 that passes through one end of screw 42 transverse to its major axis. Handle 46 desirably carries knurling 45 so that it may be easily spun between the user's thumb and forefinger when it is oriented along the major axis of screw 42 to rapidly rotate screw 42. Such knurling 45 should desirably be near the pivot pin 44 and need not be placed on the opposite end of handle 46 where pressure will be applied when handle 46 is positioned at a right angle to screw 42, as illustrated in FIG. 2. By pivoting handle 46 at right angles to screw 42, it may be used as a moment arm that facilitates exertion of substantial force to rotate screw 42. Alternatively, screw 42 can have an "Allen" head with a hexagonal recess to permit even more forceful rotation of screw 42 utilizing a hex or "Allen" wrench.

Figure 5:
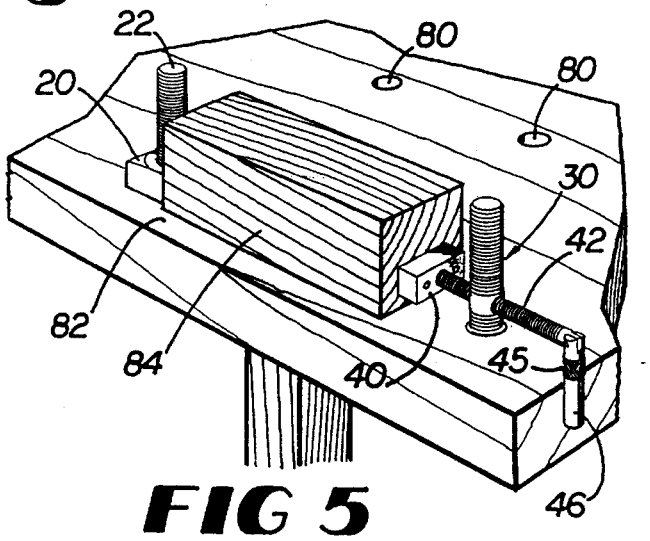
FIG. 5 is a perspective view of the panel clamping apparatus of the present invention as used with a bench top.
Figure 6:
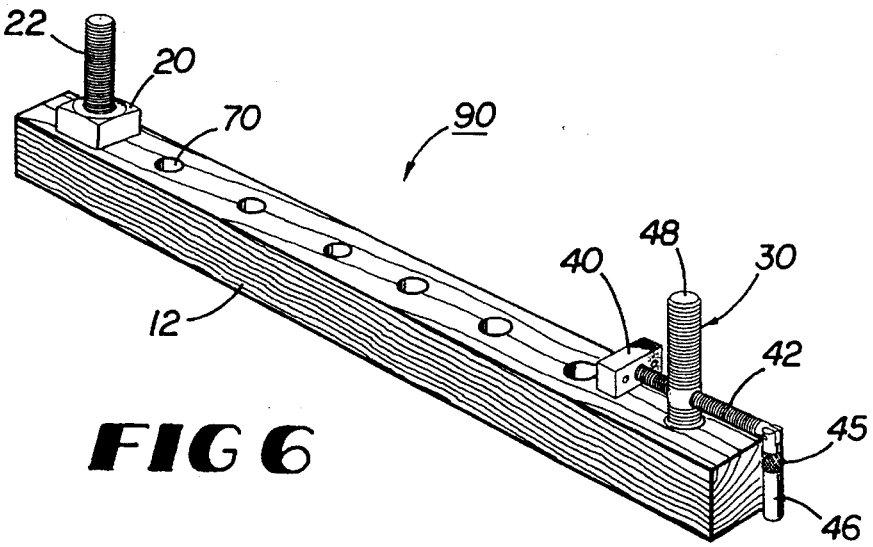
FIG. 6 is a perspective view of the panel clamping apparatus of the present invention as used with a single rail.

While only two clamping fixtures 10 are illustrated in FIG. 1, as will be readily understood by one skilled in the art, any number of clamping fixtures 10 may be utilized in gluing a panel 14 to exert pressure at appropriate intervals along its edges. Additionally, the present invention is readily adaptable to other uses such as those shown in FIGS. 5 and 6. FIG. 5 reveals the present invention used with a workbench 82 to hold a workpiece 84. FIG. 6 illustrates the present invention used as a bar clamp 90 with a single rail 12. Workpieces clamped by the bar clamp 90 or panel clamp used with workbench 82 allow the user to perform various operations upon the firmly held workpiece.

The foregoing description of this invention is for the purposes of explanation and illustration. It will be apparent to those skilled in the art that modification and changes may be made to this invention without departing from the scope and spirit of the preceding description and the following claims.

We claim:

1. A clamping apparatus for use with a rail comprising:

a. a fixed jaw post having two post ends and a pad located intermediate the two fixed jaw post ends, b. a clamping jaw post having two post ends and a threaded hole through the clamping jaw post intermediate the two clamping jaw post ends, c. positioned within the threaded hole, a clamping screw having two ends, d. a clamping pad attached to one of the screw ends, and e. means for turning the clamping screw attached to the other of the clamping screw ends.

2. The apparatus of claim 1, further comprising means for limiting penetration of at least one of the ends of each of the posts into a rail hole.

3. The apparatus of claim 2, wherein the means for limiting penetration is an O-ring on each post.

4. The apparatus of claim 2, wherein the means for limiting penetration is a nut threaded on each post.

5. The apparatus of claim 1, further comprising means for increasing friction between the posts and the rails.

6. The apparatus of claim 1, wherein the friction increasing means comprises a thread formed on the surface of each post.

7. The apparatus of claim 1, wherein the means for turning the clamping screw comprises a section of rod pivotally attached to the clamping screw end.

8. A panel clamping apparatus, comprising:

a. two clamping rails each having at least two holes, each of which holes in one of the rails matches one of the holes in the other clamping rail, b. a fixed jaw post having two post ends and a pad centrally located on the fixed post, one of which post ends is received in one of the holes in one of the rails and the other of which post ends is received in the matching hole in the other rail, and c. a clamping jaw assembly comprising a clamping post having two ends and a threaded hole through which a clamping screw is journaled to bear against a clamping pad, one of which clamping post ends is received in another of the holes in the one rail and the other of which clamping post ends is received in the matching hole in the other rail.

9. The apparatus of claim 8, further comprising means for limiting penetration of at least one of the ends of each of the posts into a rail hole.

10. The apparatus of claim 9, wherein the means for limiting penetration is a nut threaded onto the clamping jaw post.

11. The apparatus of claim 8, further comprising means for increasing friction between the posts and the rails.

12. The apparatus of claim 11, wherein the friction increasing means comprises a thread formed on the surface of each post.

13. The apparatus of claim 8, further comprising a handle pivotally attached to one of the ends of the clamping screw, wherein the handle is a section of rod.

14. An apparatus for holding workpieces, comprising:

a. a member having at least two holes, b. a fixed jaw post having two post ends and a pad centrally located on the fixed post, one of which post ends is received in one of the holes in the member, c. a clamping jaw assembly comprising a clamping post having two ends and a threaded hole through which a clamping screw is journaled to bear against a clamping pad, one of which clamping post ends is received in one of the holes in the member.

15. The apparatus of claim 14, further comprising means for limiting penetration of at least one of the ends of each of the posts into the member.

16. The apparatus of claim 14, further comprising means for increasing friction between the posts and the rails.

17. The apparatus of claim 16, wherein the friction increasing means comprises a thread formed on the surface of each post.

18. The apparatus of claim 14, wherein the member having at least two holes is the top of a bench.

19. The apparatus of claim 14, wherein the member having at least two holes is a rail.

20. The apparatus of claim 14, further comprising a handle pivotally attached to one of the ends of the clamping screw, wherein the handle is a section of rod.

* * * * *